US007522852B2

(12) United States Patent
Toyohara

(10) Patent No.: US 7,522,852 B2
(45) Date of Patent: Apr. 21, 2009

(54) IMAGE FORMING APPARATUS CAPABLE OF ACCOMPLISHING UNIFORMITY IN GLOSSINESS

(75) Inventor: Yuichiro Toyohara, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 11/500,412

(22) Filed: Aug. 8, 2006

(65) Prior Publication Data

US 2006/0269330 A1 Nov. 30, 2006

Related U.S. Application Data

(62) Division of application No. 10/900,311, filed on Jul. 28, 2004, now Pat. No. 7,113,729.

(30) Foreign Application Priority Data

Jul. 31, 2003 (JP) ..... 2003-204683

(51) Int. Cl.
*G03G 15/00* (2006.01)

(52) U.S. Cl. ..... 399/45; 399/341

(58) Field of Classification Search ..... 399/45, 399/68, 82, 53, 223, 227, 321, 341; 347/115, 347/156

See application file for complete search history.

(56) References Cited

U.S. PATENT DOCUMENTS

| | | | | |
|---|---|---|---|---|
| 5,716,750 | A | 2/1998 | Tyagi et al. | 430/124 |
| 6,363,229 | B1 | 3/2002 | Shiraishi et al. | 399/68 |
| 6,498,910 | B2 | 12/2002 | Haneda | 399/51 |
| 6,803,932 | B2 | 10/2004 | Itoh et al. | 347/112 |
| 6,819,902 | B2 | 11/2004 | Toyohara et al. | 399/298 |
| 6,996,358 | B2 | 2/2006 | Ayaki et al. | 399/223 |
| 2001/0028805 | A1 * | 10/2001 | Haneda | 399/51 |

(Continued)

FOREIGN PATENT DOCUMENTS

EP 0 794 469 A1 9/1997

(Continued)

OTHER PUBLICATIONS

Patent Abstracts of Japan, Publication No. 2002-148893, May 22, 2002.

(Continued)

*Primary Examiner*—Sophia S Chen
(74) *Attorney, Agent, or Firm*—Fitzpatrick, Cella, Harper & Scinto

(57) ABSTRACT

A toner image forming device for forming, on the basis of input image signals, a toner image on a recording material with a first toner and a second toner having the same hue as the first toner and a density different from that of the first toner. A fixing device for heating and fixing the toner image on the recording material. A selecting device for selecting either one of a first mode and a second mode, wherein a glossiness level of a toner image outputted in response to the input image signals having the same density level is higher in the second mode than in the first mode. A changing device for changing, in response to selection of said selecting means, a fixing condition of said fixing means and a use ratio of the second toner at the input image signal corresponding to a predetermined density level.

4 Claims, 16 Drawing Sheets

U.S. PATENT DOCUMENTS

| | | | | |
|---|---|---|---|---|
| 2002/0094220 | A1 | 7/2002 | Bartscher et al. | 399/341 |
| 2005/0058465 | A1 | 3/2005 | Toyohara | 399/45 |
| 2005/0058466 | A1 | 3/2005 | Toyohara | 399/45 |

FOREIGN PATENT DOCUMENTS

| | | | |
|---|---|---|---|
| JP | 4-204871 | | 7/1992 |
| JP | 5-35038 | | 2/1993 |
| JP | 6-202520 | A | 7/1994 |
| JP | 7-244414 | A | 9/1995 |
| JP | 8-220821 | | 8/1996 |
| JP | 2000-147863 | A | 5/2000 |
| JP | 2000-231279 | | 8/2000 |
| JP | 2001-290319 | A | 10/2001 |
| JP | 2001-318499 | | 11/2001 |
| JP | 2001-318499 | A | 11/2001 |
| JP | 2002-108039 | | 4/2002 |
| JP | 2002-116594 | | 4/2002 |
| JP | 2002-116631 | | 4/2002 |
| JP | 2002-148893 | | 5/2002 |
| JP | 2002-318482 | | 10/2002 |
| JP | 2002-341606 | | 11/2002 |

OTHER PUBLICATIONS

Office Action issued on Jun. 26, 2007, in counterpart Japanese Application No. 2003-2046893, along with partial English-language translation.

Office Action, dated Feb. 12, 2008, issued in European counterpart Application No.: 04 018 035.8-2209.

* cited by examiner

IMAGE FORMING APPARATUS CAPABLE OF ACCOMPLISHING UNIFORMITY IN GLOSSINESS

CROSS-REFERENCE TO RELATED APPLICATION

This application is a divisional of application No. 10/900,311, filed Jul. 28, 2004 now U.S. Pat. No. 7,113,729.

FIELD OF THE INVENTION AND RELATED ART

The present invention relates to an image forming apparatus such as an electrophotographic copying machine. In particular, it relates to an image forming apparatus capable of achieving not only a desired level of image density, but also, uniformity in glossiness, with multiple toners identical in hue and different in color density.

In recent years, need has been increasing for improving an electrophotographic image forming apparatus in image quality. In other words, need has been increasing for image forming apparatuses capable of achieving not only a desired level of color density, but also, uniformity in glossiness.

In the field of an electrophotographic image forming apparatus, a desired level of color density is achieved by controlling the amount of toner used for per unit area of recording medium.

In other words, a given area of an image lower in color density is lower in the amount of the toner used per unit area of a recording medium to form the area, being therefore smaller in dot size. However, it is difficult to reliably form dots of a small size on recording medium. Therefore, the areas of an intended image, which are low in color density, are likely to be nonuniformly reproduced in color density.

On the other hand, when forming the areas of an image higher in color density, the amount of toner used per unit area of a recording medium must be increased. However, the amount of toner transferable from an image bearing member onto a recording medium is limited, making it difficult to achieve a desired level of color density.

Therefore, multiple toners identical in hue but different in color density are used in combination as disclosed in Japanese Laid-open Patent Application 2002-148893.

More specifically, when reproducing the areas of an intended image lower in color density, dot size is increased and toner lower in color density is essentially used, in order to reliably form the dots to prevent the areas of an original, which are lower in color density, from being nonuniformly reproduced in color density.

On the other hand, when forming the areas of an intended image, which are higher in color density, a desired color density is achieved by using essentially the toner higher in color density in order to reduce the amount of the toner necessary to achieve the desired color density.

With the employment of the above described method, it became possible to form an image satisfactory in color density in that it is uniform in desired color density level from the lowest to highest levels.

However, the image forming apparatus such as the one disclosed in Japanese Laid-open Patent Application 2002-148893 suffered from problems regarding image quality, which are attributable to color density, more specifically, the problem that an image changes in glossiness as it is fixed.

SUMMARY OF THE INVENTION

Accordingly, it is a principal object of the present invention to provide an image forming apparatus wherein variation of a glossiness of the image after image fixing due to density of the image, is suppressed.

According to an aspect of the present invention, there is provided an image forming apparatus includes an image bearing member for carrying an electrostatic image; developing means for developing the electrostatic image with a plurality of toners having the same hue and having different densities; toner image formation means for forming on a recording material a toner image constituted by the toner having the same hue and different densities; and fixing means for fixing the toner image on the recording material, wherein a total of amounts per unit area of the toners which have the same hue and different densities and which constitute a part of the toner image, is substantially the same as a total of amounts per unit area of the toners which have the same hue and different densities and which constitute another part of the toner image having a different density.

These and other objects, features, and advantages of the present invention will become more apparent upon consideration of the following description of the preferred embodiments of the present invention, taken in conjunction with the accompanying drawings.

DETAILED DESCRIPTION OF PREFERRED EMBODIMENTS

Nonuniformity in glossiness attributable to the difference in color density, is reduced by making the sum of the amounts of the two or more toners, identical in hue and different color density, used per unit area of a given area of a toner image, equal to the sum of the amounts of the two or more toners, identical in hue and different in color density, used per unit area of an area different from the given area of the toner image different in color density.

Figure 20:
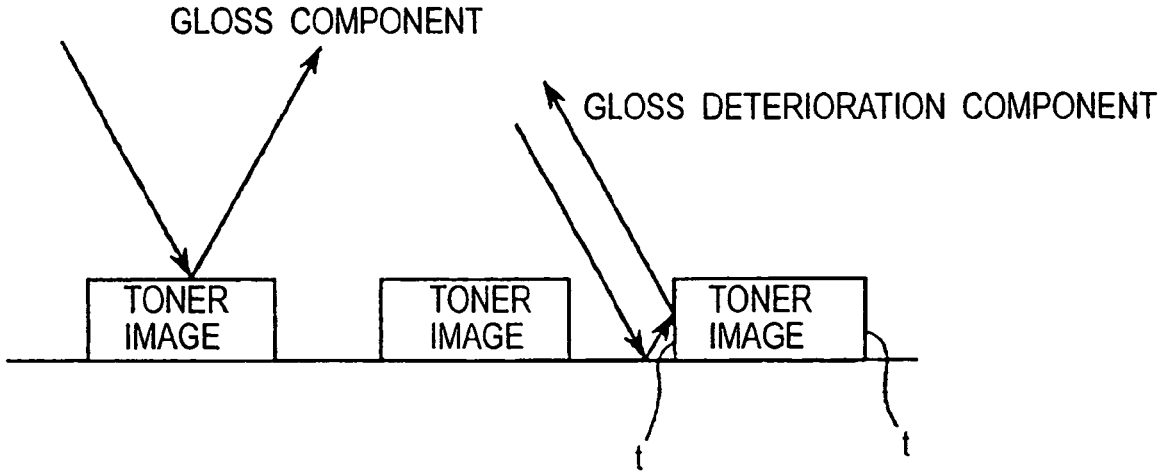
FIG. 20 is a drawing depicting the area gradation mechanism which affects the glossiness level.

FIG. 20 shows the principle of the occurrence of the nonuniformity in glossiness attributable to the nonuniformity in color density of an image to be reproduced.

When forming an image with the use of the area tone gradation method, which achieves a desired (color) density level (tone gradation level) by adjusting the amount of toner used per unit area of a recording medium, there always occur borderline portions (t) between one solid area and adjacent solid areas of the image, and the longer the borderline portions (t), the greater the amount of the reflected light irregular in direction. In other words, in a given area of an image lower in image density, the borderline portions (t) are longer, and therefore, the greater portion of the incoming light is irregularly reflected in terms of direction, reducing thereby the given area in glossiness level, whereas a given area of an image higher in image density is shorter in the borderline portion (t), being therefore smaller in the amount of the incoming light irregularly reflected in terms of direction, and therefore, being higher in glossiness level.

As described above, the glossiness of an image has a strong correlation with image density.

Therefore, according to the present invention, an arrangement is made so that in the input video signal level range in which the input video signal level is higher than a predetermined level, the sum of the amounts of the two or more toners identical in hue and different in color density, used per unit area of a recording medium, remains constant.

With the employment of the above described arrangement, even if given two areas of an image, which are formed of two or more toners identical in hue and different in tone (color) density, are different in image density, the two areas becomes roughly the same in the length of the borderline portion (t). Therefore, it is possible to reduce the level of nonuniformity in the glossiness of an image attributable to the nonuniformity in image density.

Hereinafter, the preferred embodiments of the present invention will be described with reference to the appended drawings.

Incidentally, if a component, a member, a portion, or the like in one of the embodiments has the same referential symbol as one in another embodiment, the two are identical in structure and function. Thus, once they are described, their description will not be repeated.

Embodiment 1

Figure 1:
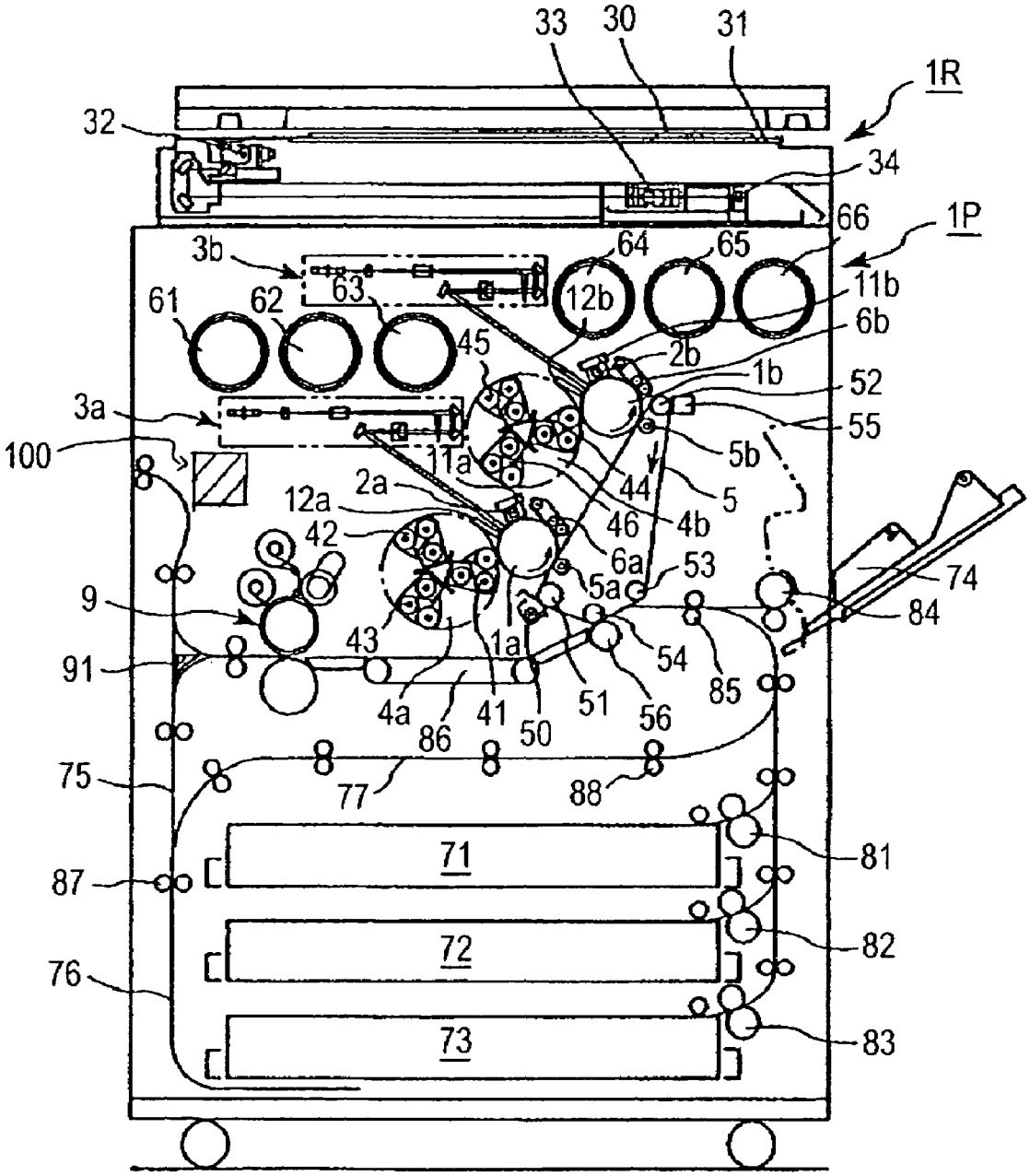
FIG. 1 is a schematic sectional view of the full-color image forming apparatus in the first embodiment of the present invention, depicting the general structure thereof.

FIG. 1 is a schematic sectional view of the electrophotographic full-color image forming apparatus in the first embodiment of the present invention, showing the general structure thereof. The full-color image forming apparatus in this embodiment comprises a digital color image reader 1R, which is located in the top portion of the apparatus, and a digital color image printing station 1P, which is in the bottom portion of the apparatus.

The image forming operation of this apparatus is as follows. That is, an original 30 is placed on the original placement glass platen 31 of the reader portion 1R, and the original 30 is scanned by an exposure lamp 32 so that the light reflected by the original 30 is focused onto the full-color CCD sensor 34 by a lens 33. As a result, video signals representing color components of the original 30 are obtained. These video signals are amplified by an unshown amplification circuit, and then, are sent to an unshown video processing unit, in which the signals are processed. Then, they are sent to the printing station 1P by way of an unshown image formation data storage portion.

To the printing station 1P, not only the signals from the reader portion 1R are sent, but also, the video signals from a computer, video signals from a facsimileing machine, etc., are sent.

Here, however, the image forming operation of the image formation station 1P will be described assuming that video signals are sent from the reader portion 1R.

The printing station 1P comprises: a pair of photosensitive drums 1*a* and 1*b* as image bearing members; a pair of pre-exposure lamps 11*a* and 11*b*; a pair of primary charging devices 2*a* and 2*b* of a corona discharge type; a pair of laser based exposure optical systems 3*a* and 3*b*; a pair of potential level sensors 12*a* and 12*b*; a pair of rotaries 4*a* and 4*b* for holding developing apparatuses; and two sets of developing apparatuses (41, 42, and 43) and (44, 45, and 46) different in spectral characteristics and mounted in the rotary; a pair of transferring apparatuses 5*a*, and 5*b*; and a pair of cleaning devices 6*a* and 6*b*. The pair of photosensitive drums 1*a* and 1*b* are rotatably supported so that they can be rotated in the direction indicated in the drawing, and the other components are disposed in the adjacencies of the peripheral surfaces of the photosensitive drums 1*a* and 1*b*, in a manner to surround the photosensitive drums 1*a* and 1*b*.

The developing apparatuses 41-46 are filled with magenta (M), cyan (C), low color density magenta toner (LM), yellow toner (Y), black toner (K), and low color density cyan toner (LC), respectively.

Incidentally, it is possible to equip the image forming apparatus with a developing apparatus containing toner of metallic color, for example, gold or silver color, a developing apparatus containing fluorescent toner, or the like, in addition to the above mentioned ones.

The developing apparatuses 41-46 in this embodiment contain two-component developer, that is, the mixture of toner and carrier. However, they may contain single-component developer. The employment of such developing apparatuses does not create any problem.

Further, the number of the developing apparatuses employed by the image forming apparatus in this embodiment is six. However, all that is necessary is that the number is no less than four; the number may be any number which is four or greater.

The video signals sent from the reader portion 1R are converted into optical signals by the laser output portion 100 of the laser based exposure optical systems 3*a* and 3*b*. The optical signals, that is, the beams of laser light modulated with the video signals, are deflected (reflected) by the polygon mirror, transmitted through the lens, deflected (reflected) by multiple mirrors, and then, are projected onto the peripheral surfaces of the photosensitive drums 1*a* and 1*b*.

When the printing station 1P is in operation, the photosensitive drum 1 (1*a* and 1*b*) is rotated in the direction indicated by an arrow mark. In terms of the image formation sequence, first, electrical charge is removed from the peripheral surface of the photosensitive drum 1 (1*a* and 1*b*) by the pre-exposure lamp 11 (11*a* and 11*b*). Then, the peripheral surface of the photosensitive drum 1 (1*a* and 1*b*) is uniformly charged by the primary charging device 2 (2*a* and 2*b*), and is exposed. As a result, an electrostatic image is formed on the peripheral surface of the photosensitive drum 1 (1*a* and 1*b*). The above described steps are carried out for each of the color components into which an intended image is separated.

Next, the developing apparatus corresponding in color component to the electrostatic latent image on the photosensitive drum 1 (1*a* and 1*b*) is moved by rotating the rotary 4 (4*a* and 4*b*) to the developing station. Then, this developing apparatus is operated to develop the latent image on the peripheral surface of the photosensitive drum 1 (1*a* and 1*b*) into a visible image (image formed of toner composed essentially of resin and pigment).

Since the image forming apparatus in this embodiment is structured as described above, the distances between its exposing stations and corresponding developing stations remain constant regardless of the color of the image being formed, making it unlikely for the monochromatic images different in color to be become different properties.

Referring to FIG. 1, each developing apparatus is supplied with toner from one of toner storage portions 61-66 (hoppers) with a predetermined timing so that the toner ratio (or amount of toner) in the developing apparatus remains constant. The toner storage portions 61-66 are located next to the laser based exposure optical system 3*a* and 3*b* in terms of the horizontal direction.

The toner image having formed on the photosensitive drum 1 (1*a* and 1*b*) is transferred (primary transfer) onto an intermediary transfer belt 5 as an intermediary transferring member, by the transferring apparatus 5 (5*a* and 5*b*). Since multiple monochromatic images are formed to form a single full-color image, they are transferred in layers onto the intermediary transfer belt 5.

The intermediary transfer belt 5 is stretched around the driver roller 51, follower roller 52, roller 53, and roller 54, and is driven by the driver roller 51. On the opposite side of the intermediary transfer belt 5 from the driver roller 51, a transfer belt cleaning apparatus 50 is located, which can be placed in contact with, or separated from, the intermediary transfer belt 5.

On the opposite side of the intermediary transfer belt 5 from the follower roller 52, a sensor 55 for detecting the deviation and color density of the image having been transferred onto the intermediary transfer belt 5 from the photosensitive drum 1 (1*a* and 1*b*) is located, which provides information for continuously adjusting each image formation station in terms of color density, amount of toner supply, image writing timing, image writing start point, etc.

After the necessary number of monochromatic toner images different in color are transferred in layers onto the intermediary transfer belt 5, the transfer belt cleaning apparatus 50 is pressed against the driver roller 51 to remove the toner remaining on the intermediary transfer belt 5 after the transfer of the toner images from the intermediary transfer belt 5 onto recording medium.

Meanwhile, from one of the recording medium storage portions 71, 72, and 73, or a manual feeding portion 74, recording mediums are conveyed, one by one, by one of the recording medium feeding means 81, 82, 83, and 84, respectively, to a pair of registration rollers 85, by which they are straightened if they are askew, and are released with a predetermined timing to be delivered to a secondary transfer station 56, in which the toner images on the intermediary transfer belt 5 are transferred onto one of the recording mediums.

After the toner images are transferred onto the given recording medium in the secondary transfer station 56, the recording medium is conveyed to a fixing apparatus 9 of a thermal roller type by way of a recording medium conveying portion 86. In the fixing apparatus 9, the toner images are fixed, and then, the recording medium is discharged into a delivery tray or a post-processing apparatus.

The surface layer of the heat roller of the fixing apparatus 9 of the image forming apparatus in this embodiment is not formed of rubber. It is such a surface layer that is formed by covering virtually the entirety of the heat roller with a tube formed of fluorinated resin. Providing the heat roller with such a surface layer prolongs the service life of the heat roller, hence, the service life of the fixing apparatus.

In order to assure that the toner layers are not substantially reduced in thickness, the amount of pressure to be applied for fixation by the fixing apparatus 9 is set to a relatively small value.

After the secondary transfer of the toner images, the toner remaining on the intermediary transfer belt 5 is removed by the transfer belt cleaning apparatus 50, and the intermediary transfer belt 5 is used again for the primary transfer process carried out in each of the image formation stations.

The operation for forming an image on both surfaces of a recording medium is as follows. Immediately after the transfer medium is passed through the fixing apparatus 9, the conveyance path guide 91 is driven, guiding the transfer medium into the reversing path 76 through the recording medium conveyance path 75. Then, the pair of reversing rollers 87 are rotated in reverse, conveying backward the transfer medium, that is, conveying the transfer medium in the direction opposite to the direction in which the transfer medium was guided into the reversing path 76, in other words, the end of the transfer medium, which was trailing when the transfer medium was guided into the reversing path 76, becoming the leading end. As a result, the transfer medium is moved into the two-sided print mode path 77. Thereafter, the transfer medium is conveyed by the pair of two-sided print mode rollers 88 to the aforementioned pair of registration rollers 85 through the two-sided print mode path 77. Then, it is straightened if it is askew, and is released with the predetermined timing, so that an image is transferred through the above described image formation process, onto the opposite surface of the transfer medium from the surface on which an image has been already formed.

Next, the image processing method employed by the image forming apparatus in this embodiment will be described.

As described above, this image forming apparatus is provided with two cyan color toners, which are identical in hue and different in color density, that is, cyan color toner higher in color density (which hereinafter may be referred to as "high color density cyan toner") and cyan color toner lower in tone color density (which hereinafter may be referred to as "low color density cyan toner"), and two magenta color toners, which are identical in hue and different in color density, that is, magenta color toner higher in color density (which hereinafter may be referred to as "high color density magenta toner") and magenta color toner lower in tone color density (which hereinafter may be referred to as "low color density magenta toner").

That two toners are identical in hue, but different in color density, ordinarily means that the two toners are identical in the spectral characteristics of the coloring ingredient contained in the toners composed essentially of resin and coloring ingredient (pigment), but are different the amount of the coloring ingredient. In other words, the low color density toner means one of the two toners identical in hue, which is lower in color density than the other.

Further, that two toners are identical in hue generally means that the two toners are identical in the spectral characteristics of the coloring ingredient (pigment) they contain. However, it includes the case in which in strict terms, the two toners are not identical in spectral characteristic of the coloring ingredient, but they are identical in terms of the ordinary perception of color, for example, magenta, cyan, yellow, black, etc.

As far as the present invention is concerned, when the two toners are identical in hue and different in color density, that the toner is low in color density (low color density toner) means that when the amount of the toner used per unit area of recording medium is 0.5 mg/cm$^2$, the optical color density of the toner layer formed of this toner is no more than 0.1 after fixation, whereas that the toner is high in color density (high color density toner) means that when the amount of the toner used per unit area of recording medium is 0.5 mg/cm$^2$, the optical color density of the toner layer formed of this toner is no less than 0.1 after fixation.

In this embodiment, the amount of the pigment in the high color density toner has been adjusted so that when the amount of this toner on a recording medium is 0.5 mg/cm$^2$, the optical color density of the toner layer formed of this toner will become 1.6 as the toner layer is fixed, whereas the amount of the pigment in the low color density toner has been adjusted so that when the amount of the toner on a recording medium is 0.5 mg/cm$^2$, the optical color density of the toner layer formed of this toner will become 0.8 as the toner layer is fixed. The high and low color density cyan toners, and high and low color density magenta toners, are skillfully used in combination, to achieve cyan and magenta colors different in color density.

Figure 2:
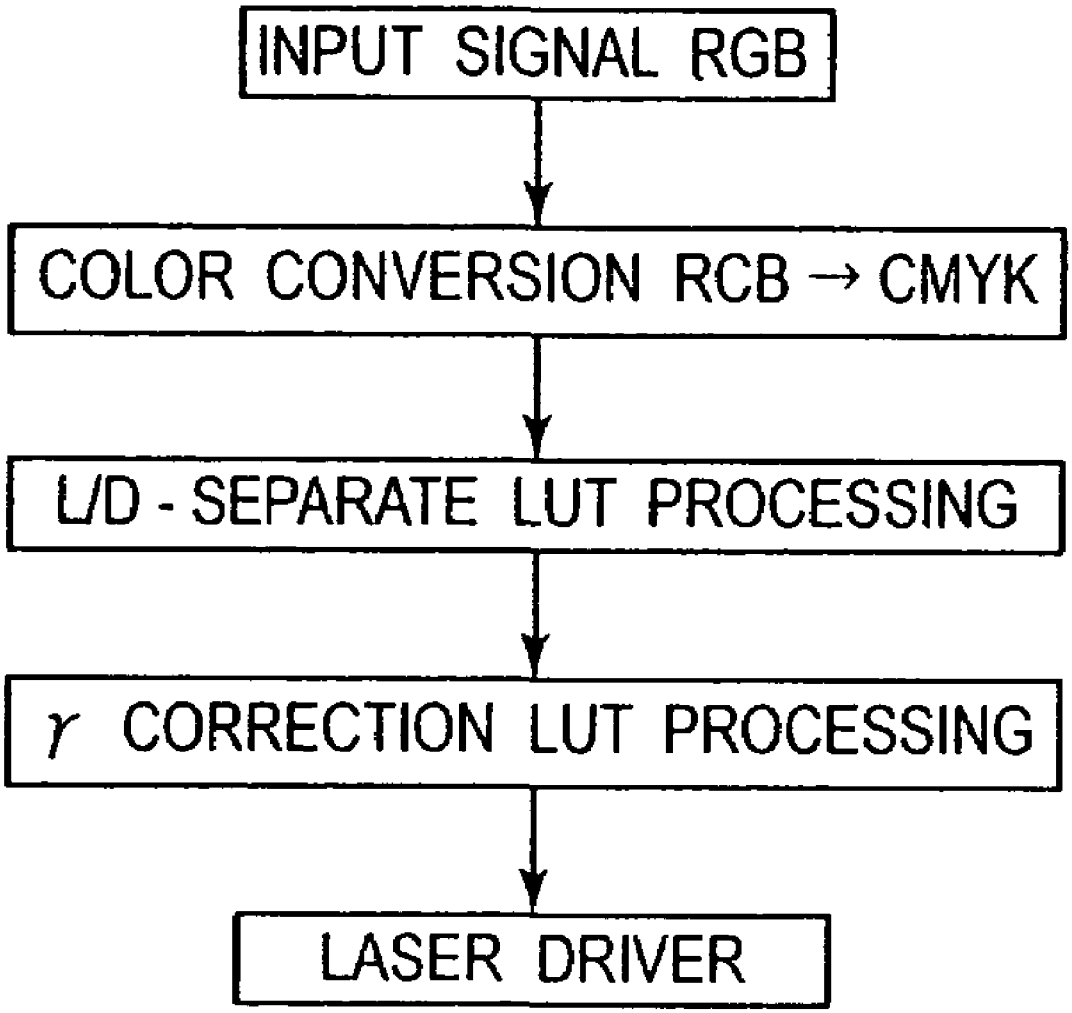
FIG. 2 is a basic flowchart of a method for controlling the image forming apparatus in accordance with the present invention.

Given in FIG. 2 is the basic flowchart followed by the image forming apparatus in this embodiment, for processing video signals.

Referring to FIG. 2, in this embodiment, the inputted video signals corresponding to the color components, such as R, G, B, etc., of an intended image, are converted in color into video signals representing C (cyan), M (magenta), Y (yellow), and K (black) color components. Then, the C, M, Y, and K video signals are separated in color density, based on a look-up table (which hereinafter will be referred to as LUT), such as the one shown in FIG. 3, which will be described later in more detail (high and low color density video signal apportionment LUT process). Thereafter, the video signals representing the high color density and video signals representing the low color density are subjected to their own gamma correction processes, and are used to drive laser drivers in order to output images.

The resolution of this image forming apparatus is 200 dpi.

As described above, the greater the amount of the toner used per unit area of a recording medium, the higher the level of glossiness of a toner image after fixation.

Figure 3:
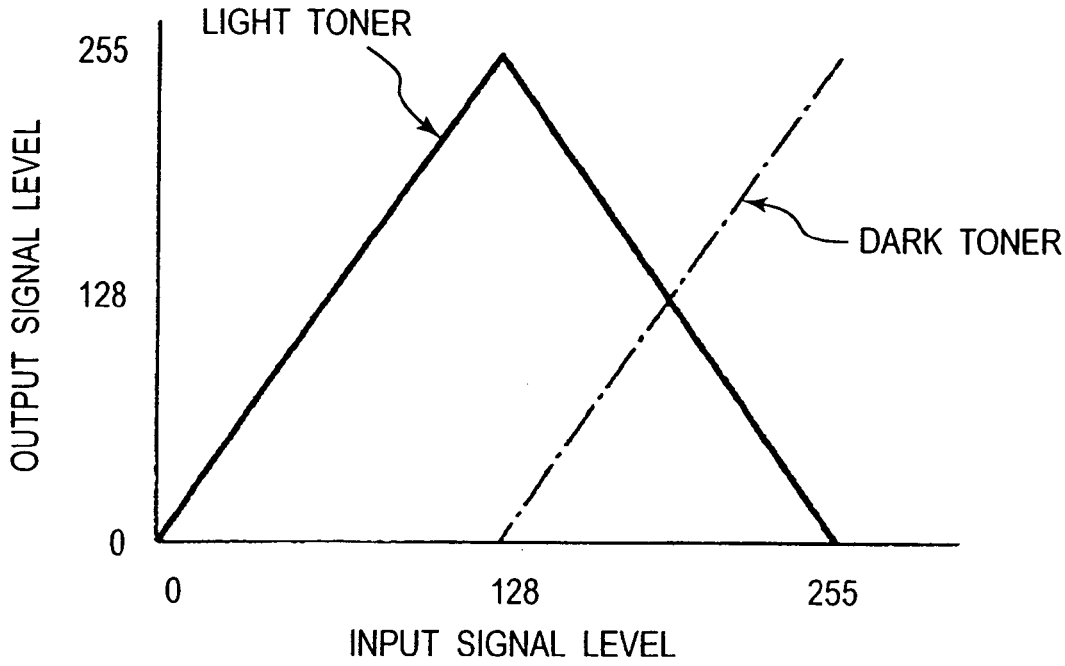
FIG. 3 is a graph showing the patterns of the high and low color density video signal apportionment LUT in the first embodiment of the present invention.
Figure 4:
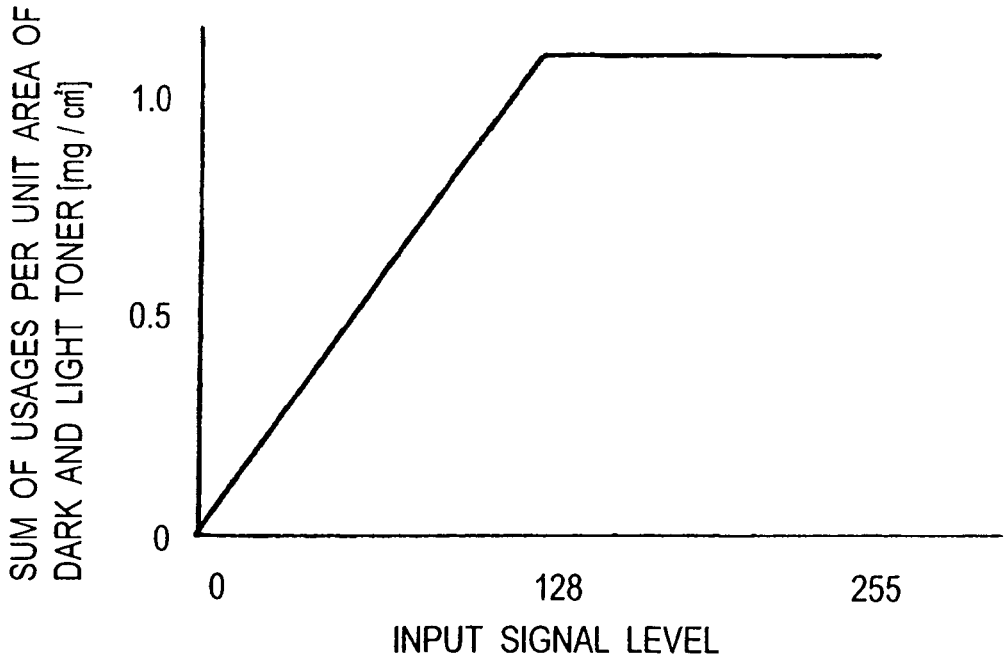
FIG. 4 is a graph showing the relationship between the input signal level and the sum of the high and low color density toners used per unit area of a recording medium.

In this embodiment, the high and low color density video signal apportionment LUT shown in FIG. 3 is used. With use of this LUT, both of the high color density toner and low color density toner are used. Further, an arrangement is made so that in the input signal level range, in which the input signal level is no less than 128, the sum of the amounts of high and low color density toners used per unit area of a recording medium remains constant, as shown in FIG. 4. Providing the input signal level range, in which the sum of the amount of the high color density toner usage per unit area of recording medium and the amount of the low color density toner usage per unit area of recording medium, enlarges the overall size of the areas of a toner image, in which the borderline portions (t) are identical in length as shown in FIG. 20, making it possible to minimize the toner image from becoming nonuniform in glossiness as it is fixed.

It is also possible to use no fewer than three toners per color component, identical in hue and different in color density. FIG. 1 shows an example of an image forming apparatus which uses three toners identical in hue but different in color density.

More specifically, the image forming apparatus shown in FIG. 1 uses yellow toner, magenta toner, black toner, high color density cyan toner, low color density cyan toner, and super low color density cyan toner. In other words, it uses three cyan toners different in color density. The high color density cyan toner is adjusted in pigment so that when the amount of this toner deposited per unit area of recording medium is 0.5 mg/cm$^2$, the optical color density level of the toner layer (toner image) formed of this toner will become 1.6 as the toner layer is fixed. The low color density cyan toner is adjusted in pigment so that when the amount of this toner deposited per unit area of recording medium is 0.5 mg/cm$^2$, the optical color density level of the toner layer (toner image) formed of this toner will become 0.8 as the toner image is fixed. Further, super low color density cyan toner is adjusted in pigment so that when the amount of this toner deposited per unit area of recording medium is 0.5 mg/cm$^2$, the optical color density level of the toner layer (toner image) formed of this toner will become 0.4 as the toner layer is fixed. In the developing apparatuses 41-46 of this image forming apparatus, magenta toner, high color density cyan toner, super low color density cyan toner, yellow toner, black toner, and low color density cyan toner, are stored, respectively. The image forming method employed by this image forming apparatus shown in FIG. 1 when its six developing apparatuses are filled with the above listed toners, one for one, is the same as the one employed when the six developing apparatuses of this image forming apparatus are filled with the yellow toner, cyan toner, magenta toner, black toner, high color density cyan toner, and low color density magenta toner, one for one.

Figure 5:
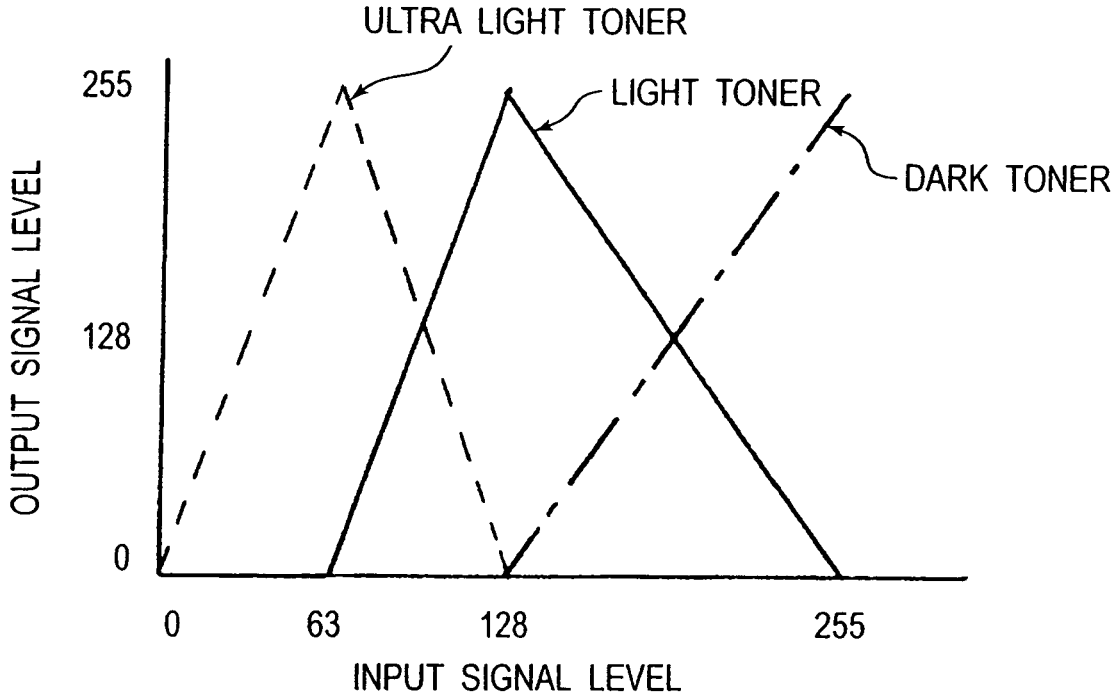
FIG. 5 is a graph showing the patterns of the LUT employed when three toners identical in hue but different in color density are used by the image forming apparatus in the first embodiment.

FIG. 5 is the LUT used by this image forming apparatus which uses three cyan toners different in color density.

Embodiment 2

Not only is the glossiness of a toner image on a recording medium affected by the amount of the toner used per unit area of the recording medium, but also, the glossiness level of the recording medium itself.

In particular, when forming a toner image on a recording medium with a high level of glossiness, the effect of the glossiness level of the recording medium upon the glossiness level of the toner image, which will be achieved as the toner image is fixed, is substantial.

Figure 6:
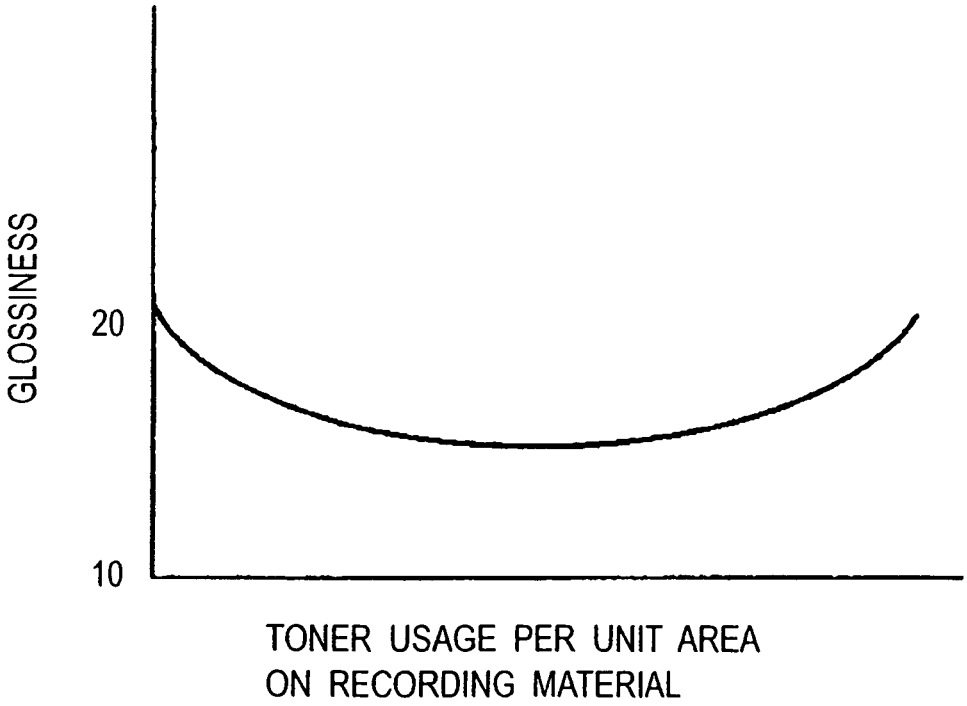
FIG. 6 is a graph showing the relationship between the amount of toner usage per unit area of a high gloss recording medium, and resultant level of glossiness.

FIG. 6 is a graph showing the relationship between the amount of toner used per unit area of a recording medium, and the glossiness level of the toner image which was achieved as the toner image was fixed. This graph shows that the area greater in the amount of toner used per unit area of the recording medium, and the area smaller in the amount of toner used per unit area of the recording medium, are higher in the glossiness level than the area medium in the amount of toner used per unit area of the recording medium.

The reason why the area greater in the amount of toner used per unit area of the recording medium became higher in the glossiness level is the same as the one given in the description of the first embodiment; because the borderline portions (t) becomes shorter.

The reason why the area smaller in the amount of toner used per unit area of the recording medium became higher in the glossiness level is as follows. That is, it is smaller in the overall size of the areas covered with toner. Therefore, the effect of the glossiness level of the recording medium itself upon the glossiness of an image, which was achieved as the image was fixed, was substantial.

As described above, when forming a toner image on a recording medium with a high level of glossiness, the glossiness level of the image which will be achieved as the image is fixed is substantially affected by the amount of toner used per unit area of the recording medium. Therefore, it is desired to employ a high and low color density video signal apportionment LUT (which hereinafter may be referred to as high gloss paper mode LUT), such as the one used in the first embodiment, in which in the input signal level range, in which the input signal level is higher than a predetermined value, the sum of the amount of the high color density toner used per unit area of a recording medium, and the amount of the low color density toner used per unit area of a recording medium, remains constant.

In comparison, when forming an image on a piece of high quality paper, that is, a recording medium, the glossiness level of which is not really high, the effect of the glossiness level of the recording medium itself upon the glossiness level of an image which will be achieved as the image is fixed is relatively small, and therefore, the areas of the image, which are smaller in the amount of toner used per unit area thereof, do not increase in glossiness level as they are fixed.

Also when forming an image on a piece of high quality paper, that is, a recording medium, the glossiness level of which is not really high, the areas of an image, which are greater in the amount of toner per unit area thereof, do not increase in the level of glossiness as they are fixed, for the following reason. That is, recording medium low in glossiness level is not really high in the level of surface flatness. Therefore, even if a substantial amount of toner is deposited on the recording medium, the toner layer (toner image) formed as the toner is deposited thereon does not become flat across its surface as it is formed. Therefore, the borderline portions (t) of the image are short. Therefore, light is irregularly reflected by the surface of the toner layer (toner image).

As described above, when an image is formed on a recording medium, the glossiness level of which is not really high, the effect of the amount of toner used per unit area of the recording medium upon the glossiness level of the image which will be achieved as the image is fixed is not substantial.

Incidentally, when forming an image in the high gloss paper mode, a large amount of toner is used, increasing therefore image formation cost.

Thus, when forming an image on a recording medium which is not really high in glossiness level, the standard paper mode is to be used, which has the range in an LUT, in which the sum of the amounts of the high and low color density toners used per unit area of this recording medium for forming a toner image, the glossiness level of which is the same as that of a toner image formed in the high gloss paper mode, is smaller than the total amount of the toner used in the high gloss paper mode.

In this embodiment, the high and low color density video signal apportionment LUT is switched by the laser output portion 100.

Next, the image forming operation in this embodiment will be described.

Figure 7:
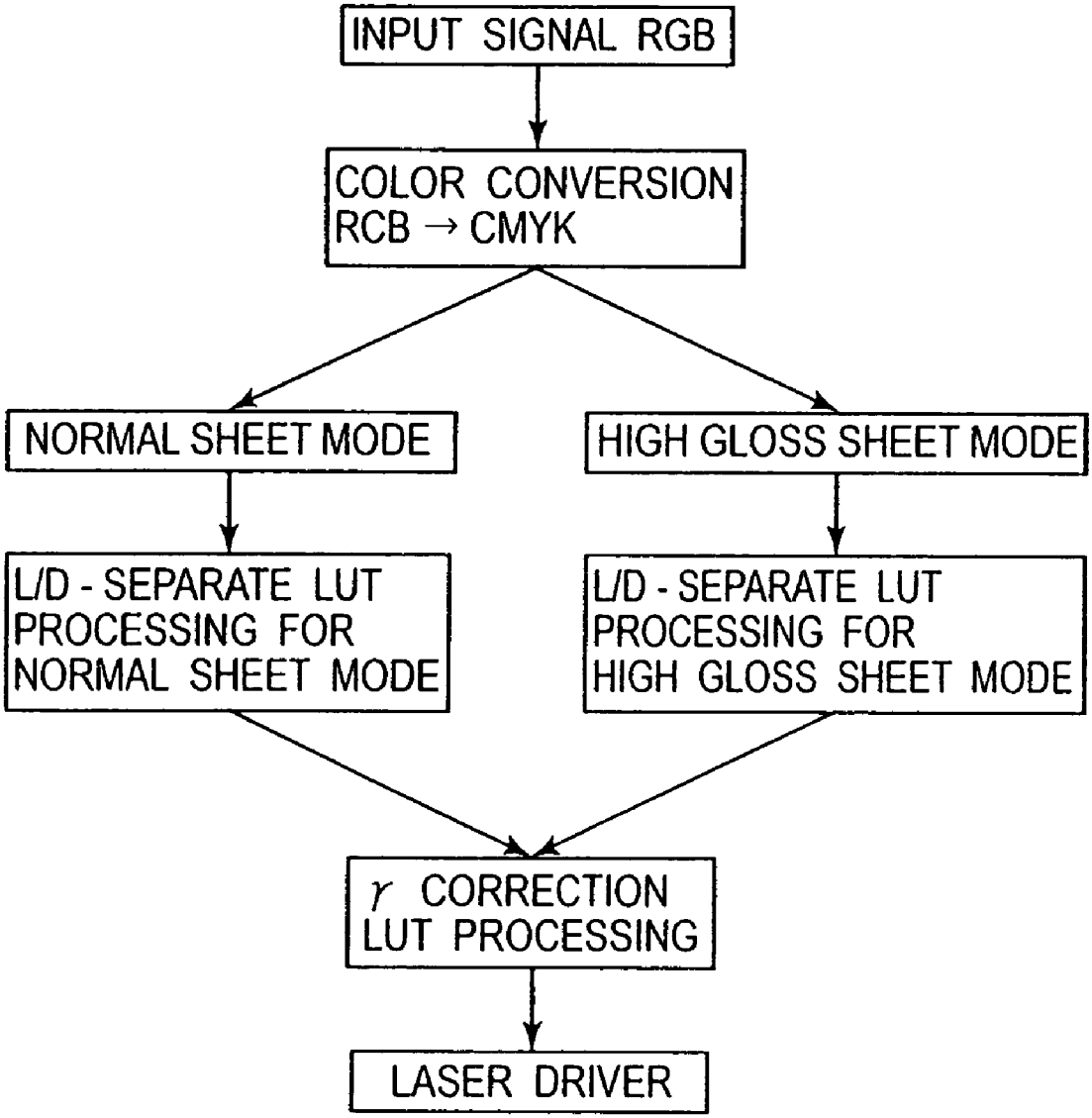
FIG. 7 is a flowchart for the control of the image forming apparatus in the second embodiment of the present invention.

FIG. 7 is a flowchart for the image forming operation in this embodiment. As is evident from the control flowchart in FIG. 7, the image forming apparatus is enabled to form an image in two glossiness modes, that is, the standard paper mode and high gloss paper mode.

In the high gloss paper mode, the high and low color density video signal apportionment process based on an LUT is carried out with reference to such an LUT as the one shown in FIG. 3. In the standard paper mode, the high and low color density video signal apportionment process based on an LUT is carried out with reference to such an LUT as the LUT shown in FIG. 8.

Figure 9:
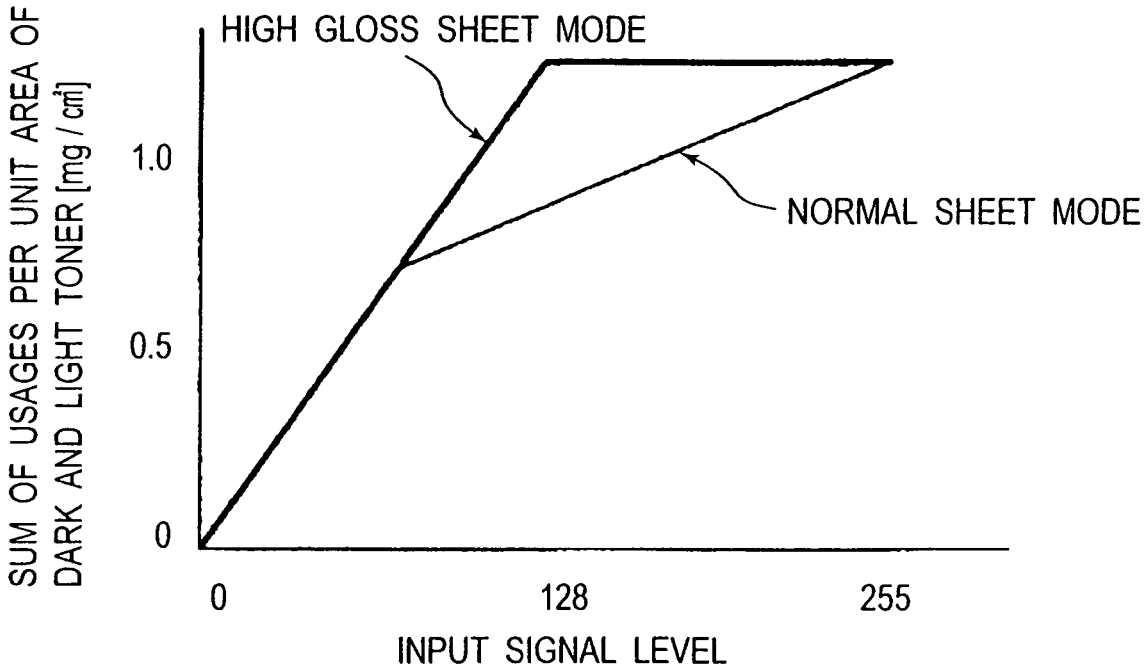
FIG. 9 is a graph showing the relationship between the input signal level and the high and low color density toners used per unit area of a recording medium, in the second embodiment.

FIG. 9 shows the relationship between the sum of the amounts of the high and low color density toners transferred onto recording medium per unit area of the recording medium, and the input signal level.

Figure 8:
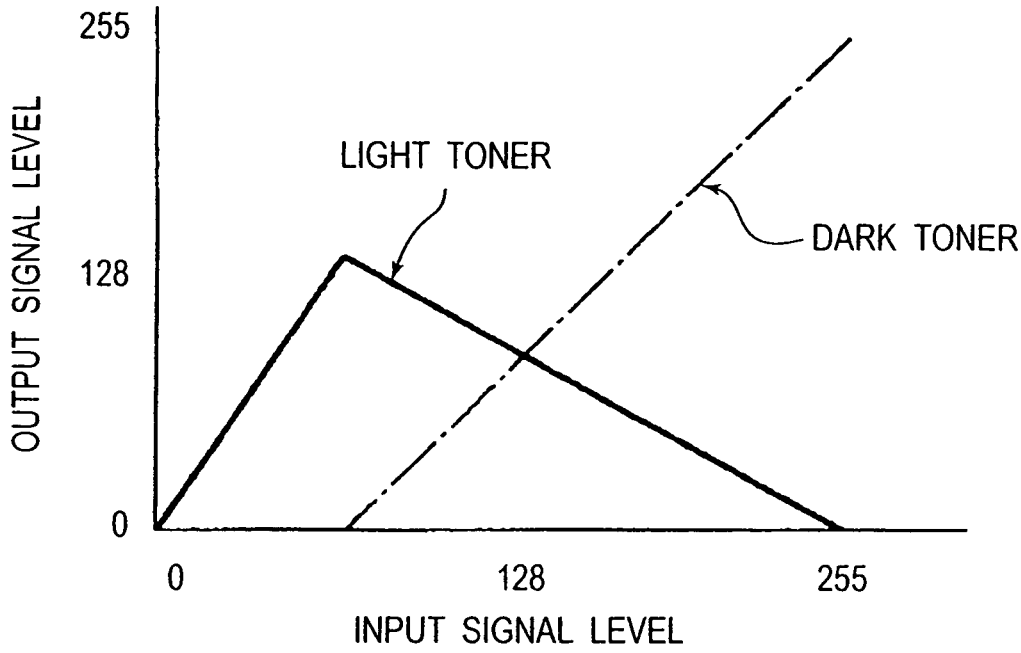
FIG. 8 is a graph showing the pattern of the high and low color density video signal apportionment LUT employed when the image forming apparatus in the second embodiment is operated in the standard paper mode.
Figure 10:
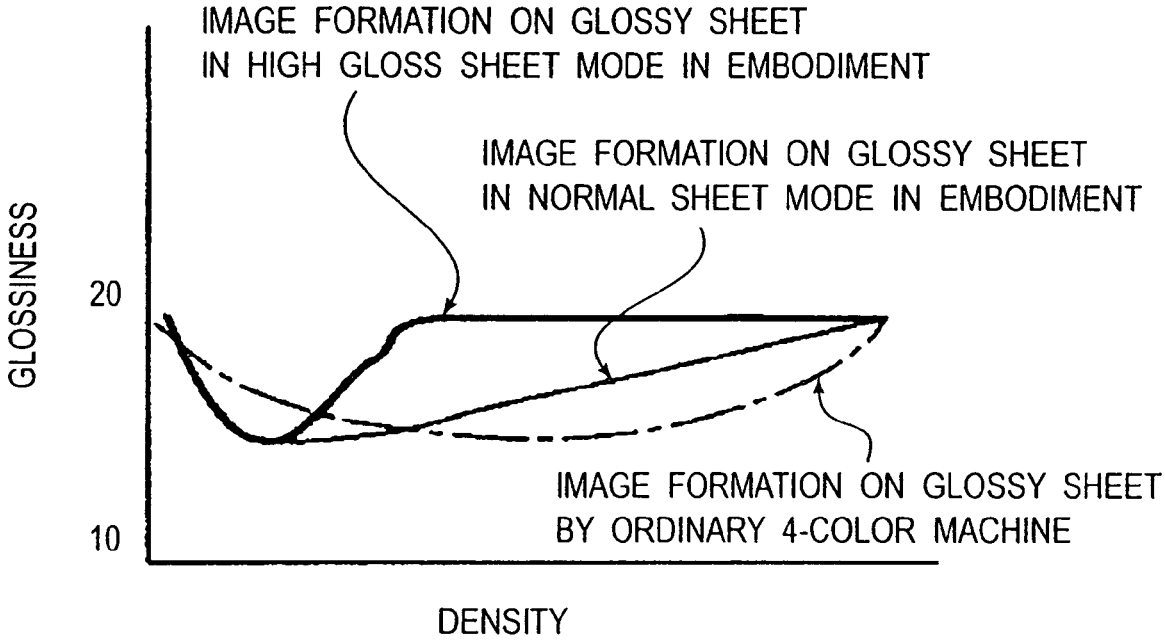
FIG. 10 is a graph showing the relationship between the color density level, and the glossiness level achieved when an image was formed on a high gloss paper in the high gloss paper mode by the image forming apparatus in the second embodiment.

Referring to FIGS. 3 and 8, in the high gloss paper mode, the halftone level at or above which the high color density toner is used for halftone reproduction is made lower than that at or above which the high color density toner is used for halftone reproduction. Therefore, the amount of toner transferred onto recording medium per unit area of the recording medium reaches its plateau at the lower halftone level, as shown in FIG. 9, increasing thereby the size of the sum of the areas which are uniform in glossiness. FIG. 10 is a graph showing the relationship among the glossiness level, color density, and print modes (high gloss paper mode and standard paper mode). The glossiness levels in FIG. 10 were those measured with the use of a 60 degree glossimeter. The switching between the low and high gloss paper modes is made by the laser output portion 100.

Figure 11:
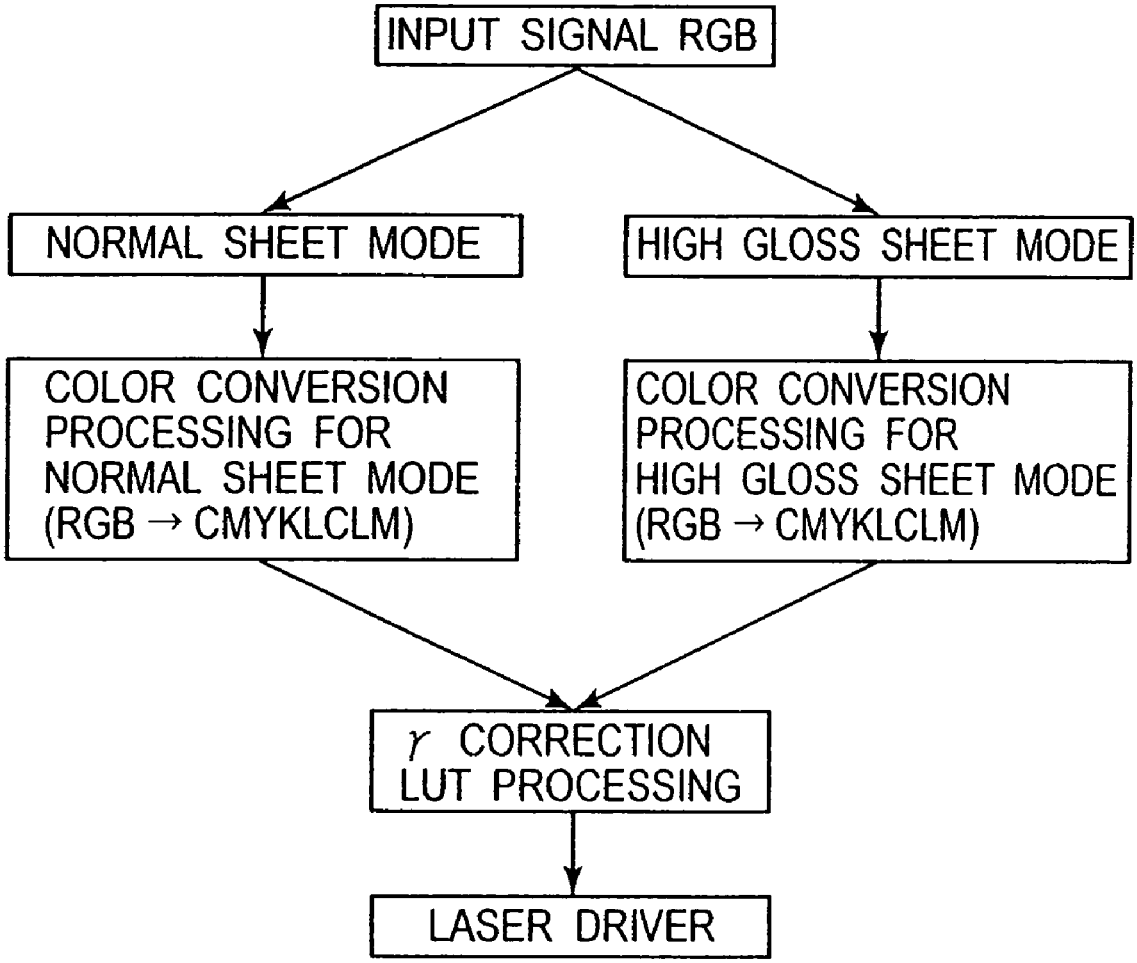
FIG. 11 is a flowchart for the control of the image forming apparatus in another embodiment of the present invention.

The above described color conversion process and color density separation process may be replaced with an operational section which carries out the direct mapping process represented by the flowchart shown in FIG. 11. In this case, the difference between the standard mode and high gloss mode is the same as the one described above. This direct mapping process is such a process that directly converts the RGB inputs into six colors, or the C (cyan), M (magenta), Y (yellow), K (black), LC (low color density cyan), LM (medium color density cyan). Further, the mapping process is changed according to the print mode in terms of glossiness; the image forming apparatus is designed so that when the apparatus is in the standard paper mode, the amount of the low color density toner is greater than when the apparatus is in the high gloss paper mode.

In terms of the glossiness level, the image forming apparatuses in the preceding embodiments were enabled to operate in only two modes, or the standard and high gloss paper modes. However, it is possible to enable an image forming apparatus to operate in three or more glossiness modes.

Figure 12:
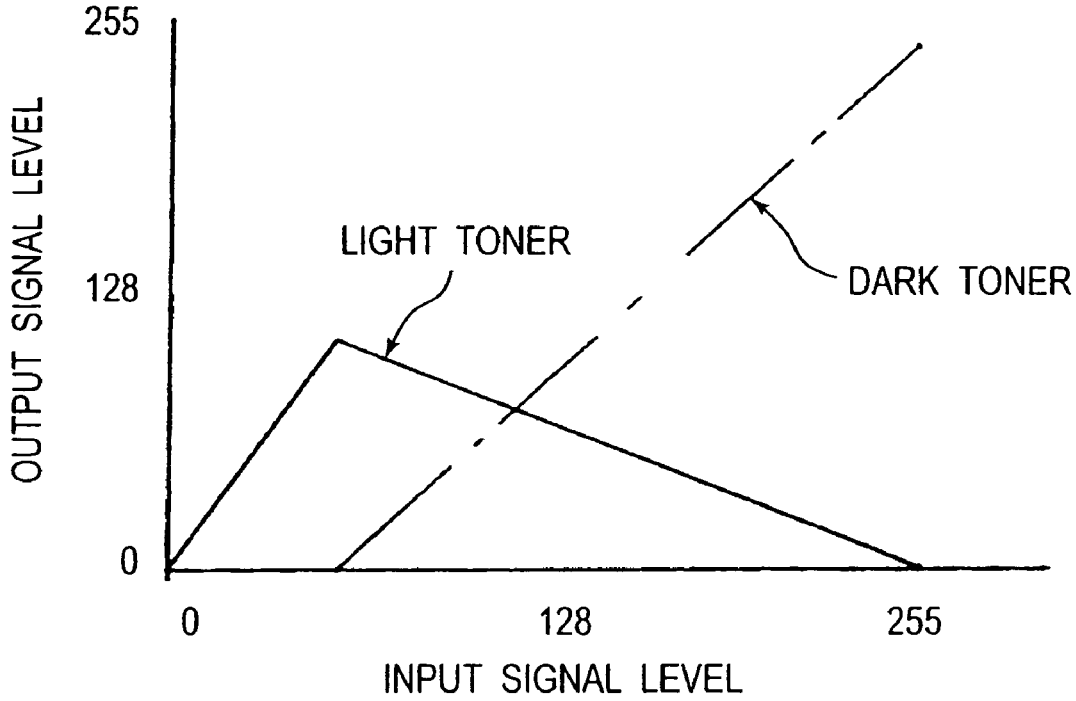
FIG. 12 is a graph showing the patterns of the high and low color density video signal apportionment LUT employed when the image forming apparatus in the second embodiment was operated in the low gloss paper mode.
Figure 13:
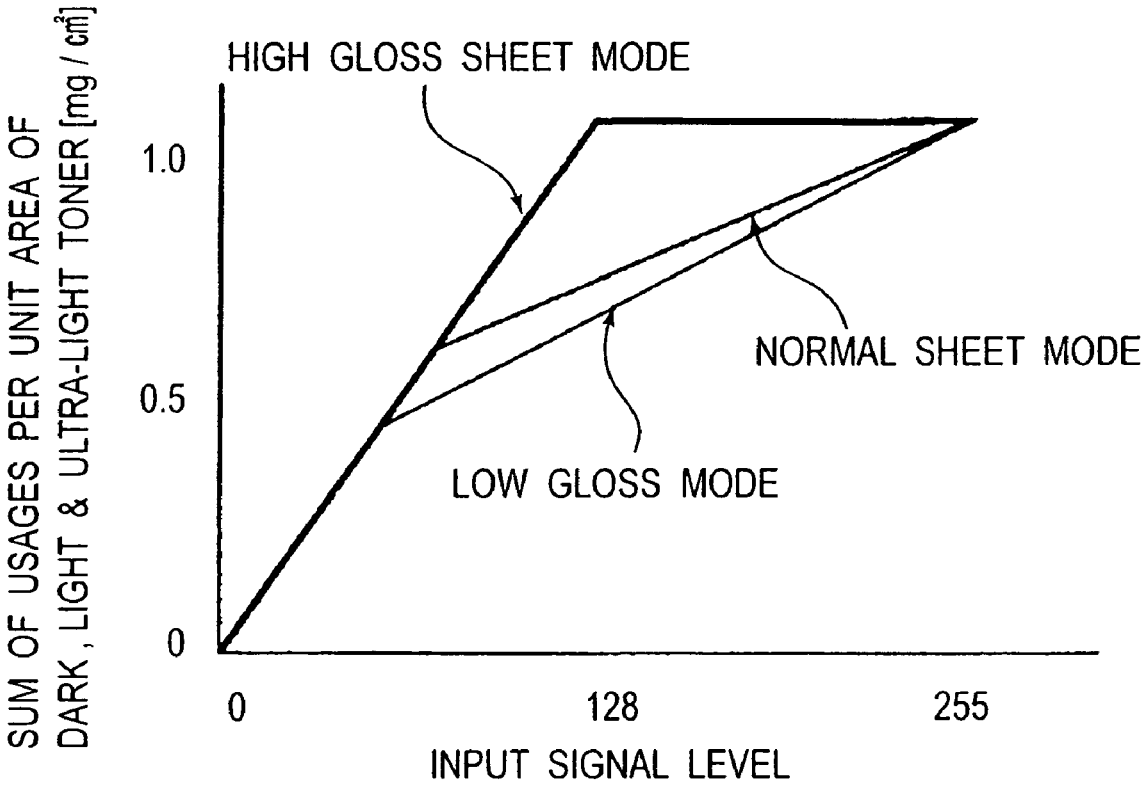
FIG. 13 is a graph showing the relationship between the input signal level and the sum of the high and low density toners used per unit area of a recording medium when the image forming apparatus in the first embodiment was used in the high, standard, and low gloss modes.

In other words, it is possible to enable an image forming apparatus to operate in the low gloss paper mode for forming an image on such recording medium as bonded paper which is very low in surface flatness, in addition to the aforementioned standard and high gloss paper modes. In the low gloss paper mode, the LUT shown in FIG. 12 is used. When forming a toner image, the color density of which is the same as that of a toner image formed in the standard paper mode, the LUT is provided with the input signal level range, in which the sum of the high and low color density toners used per unit area of a recording medium is smaller than that in the standard paper mode. FIG. 13 shows the relationship among the sum of the super low, low, and high color density toners used per unit area of a recording medium, input signal level, and operational mode (low, standard, and high gloss paper modes) after the high and low color video signal apportionment.

Embodiment 3

Figure 14:
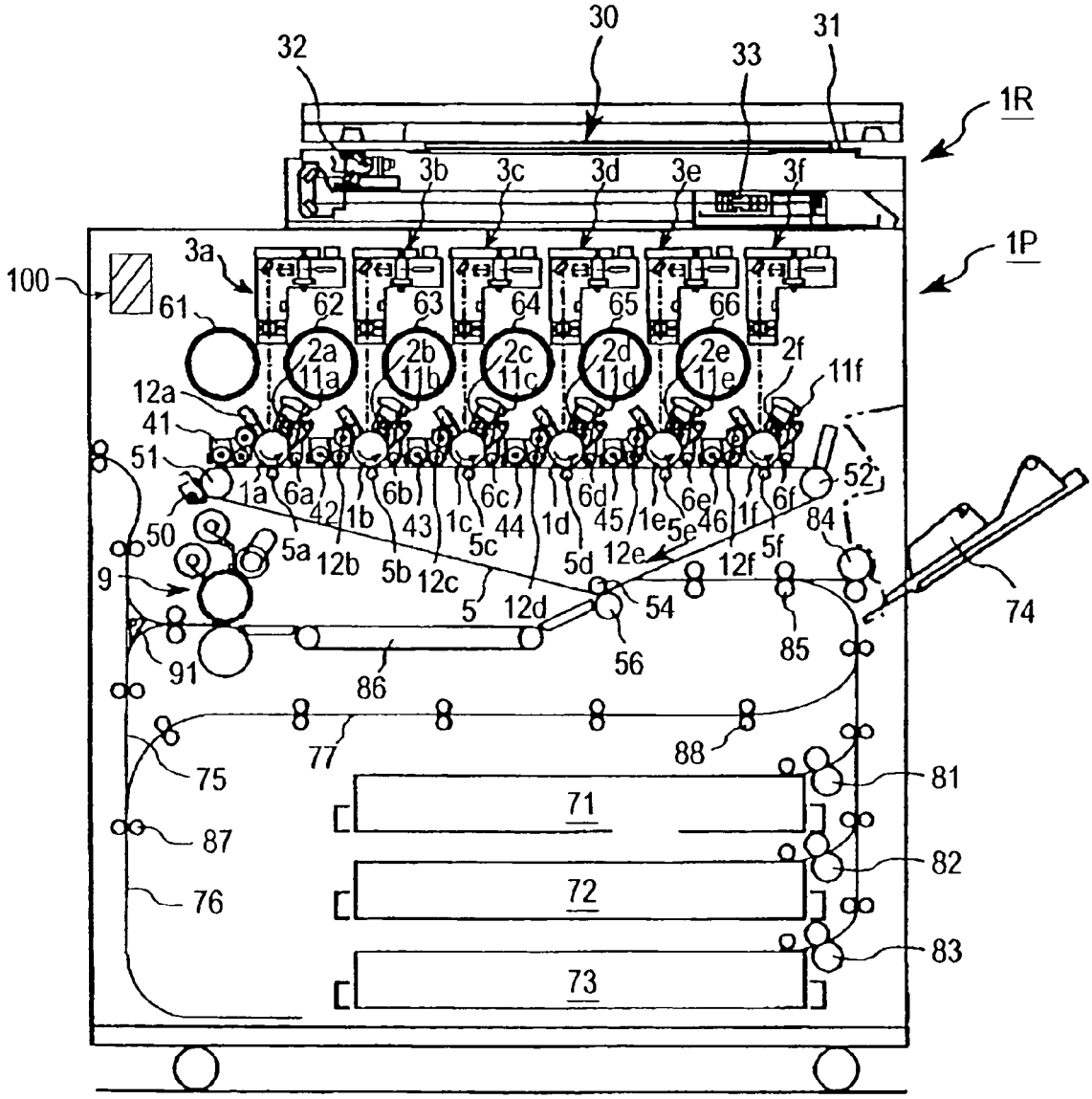
FIG. 14 is a schematic sectional view of the full-color image forming apparatus in the third embodiment of the present invention.

FIG. 14 is a schematic sectional view of the image forming apparatus in the fourth embodiment of the present invention, showing the general structure thereof. The image forming apparatus in this embodiment is of a tandem type having six image bearing members 1*a*, 1*b*, 1*c*, 1*d*, 1*e*, and 1*f*.

The components, members, portions, etc., of this image forming apparatus, identical in function to those of the image forming apparatus in the first embodiment, will be given the same referential numbers as those given in the first embodiment. Next, the structure of this image forming apparatus will be described.

Referring to FIG. 14, the image forming apparatus has six developing apparatus, and six photosensitive drums as image bearing members.

In other words, the image forming apparatus in this embodiment is a full-color image forming apparatus. It comprises a digital color image reader 1R, which is located in the top portion of the apparatus, and a digital color image printing station 1P, which is in the bottom portion of the apparatus.

The image forming operation of this apparatus is as follows. That is, an original 30 is placed on the original placement glass platen 31 of the reader portion 1R, and the original 30 is scanned by an exposure lamp 32 so that the light reflected by the original 30 is focused onto the full-color CCD sensor 34 by a lens 33. As a result, electrical signals (video signals) representing color components of the original 30 are obtained. These video signals are amplified by an unshown amplification circuit, and then, are sent to an unshown video processing unit, in which the signals are processed. Then, they are sent to the printing station 1P by way of an unshown image formation data storage.

To the printing station 1P, not only the signals from the reader portion 1R are sent, but also, the video signals from a computer, video signals from a facsimileing machine, etc., are sent.

However, the image forming operation of the image formation station 1P will be described assuming that video signals are sent from the reader portion 1R.

The printing station 1P comprises: the six photosensitive drums 1*a*, 1*b*, 1*c*, 1*d*, 1*e*, and 1*f* as image bearing members; six pre-exposure lamps 11 (11*a* 11 *b*, 11*c*, 11*d*, 11*e*, and 11*f*); six primary charging devices 2 (2*a*, 2*b*, 2*c*, 2*d*, 2*e*, and 2*f*) of a corona discharge type; six laser based exposure optical systems 3 (3*a*, 3*b*, 3*c*, 3*d*, 3*e*, and 3*f*); six potential level sensors 12 (12*a*, 12*b*, 12*c*, 12*d*, 12*e*, and 12*f*); six developing apparatuses (41, 42, 43, 44, 45, and 46) containing six toners different in spectral characteristic, one for one; six transferring apparatuses 5 (5*a*, 5*b*, 5*c*, 5*d*, 5*e*, and 5*f*); and six cleaning devices 6 (6*a*, 6*b*, 6*c*, 6*d*, 6*e*, and 6*f*. The six photosensitive drums 1 (1*a*, 1*b*, 1*c*, 1*d*, 1*e*, and 1*f*) are rotatably supported so that they can be rotated in the direction indicated in the drawing, and the other components are disposed in the adjacencies of the peripheral surfaces of the corresponding photosensitive drums 1 (1*a*, 1*b*, 1*c*, 1*d*, 1*e*, and 1*f*), in a manner to surround the photosensitive drums 1 (1*a*, 1*b*, 1*c*, 1*d*, 1*e*, and 1*f*), one for one.

In this embodiment, the six image bearing members 1 (1*a*, 1*b*, 1*c*, 1*d*, 1*e*, and 1*f*), and the six pre-exposure lamps 11, six primary charging devices 2 of a corona discharge type, six laser based exposure optical systems 3, six potential level sensors 12, six developing apparatuses (41, 42, 43, 44, 45, and 46), six transferring apparatus 5, and six cleaning devices 6, which are located in the adjacencies of the peripheral surfaces of the six image bearing members 1, one for one, in a manner to surround the image bearing members 1, make up six image formation stations. However, the number of the image formation stations does not need to be limited to six. It may be any number no less than four.

The developing apparatuses 41-46 are filled with low color density magenta toner (LM), low color density cyan toner (LC), yellow toner (Y), magenta toner (M), cyan toner (C), and black toner (K), respectively.

The developing apparatuses 41-46 are filled with low color density magenta toner (LM), low color density cyan toner (C), yellow toner (Y), magenta toner (M), cyan toner (C), and black toner (K), respectively.

The developing apparatuses 41-46 in this embodiment contain two-component developer, or the mixture of toner and carrier. However, they may contain single-component developer. The employment of such developing apparatuses does not create any problem. In this embodiment, the same developers as those in the first embodiment, that is, magenta toner (M), cyan toner (C), yellow toner (Y), low color density magenta toner (LM), low color density cyan toner (LC), and black toner (K), are used.

The video signals sent from the reader portion 1R are converted into optical signals by the laser based exposure optical systems, that is, scanners 3 (3*a*, 3*b*, 3*c*, 3*d*, 3*e*, and 3*f*). The optical signals, that is, the beams of laser light modulated with the video signals, are deflected (reflected) by the polygon mirror, transmitted through the lens, deflected (reflected) by multiple mirrors, and then, are projected onto the peripheral surfaces of the photosensitive drums 1 (1*a*, 1*b*, 1*c*, 1*d*, 1*e*, and 1*f*).

When the image formation stations 1P of the printer are in operation, the photosensitive drum 1(1*a*, 1*b*, 1*c*, 1*d*, 1*e*, and 1*f*) is rotated in the direction indicated by an arrow mark. In terms of the image formation sequence, first, electrical charge is removed from the photosensitive drum 1 (1*a*, 1*b*, 1*c*, 1*d*, 1*e*, and 1*f*) by the pre-exposure lamp 11 (11*a*, 11*b*, 11*c*, 11*d*, 11*e*, and 11*f*). Then, the photosensitive drum 1 (1*a*, 1*b*, 1*c*, 1*d*, 1*e*, and 1*f*) is uniformly charged by the primary charging device 2 (2*a* and 2*b*), and is exposed to the exposure light corresponding to a specific toner among the aforementioned six toners. As a result, an electrostatic image is formed on the peripheral surface of the photosensitive drum 1 (1*a*, 1*b*, 1*c*, 1*d*, 1*e*, and 1*f*). The above described steps are carried out for each of the color components into which an intended image is separated.

Next, the developing apparatuses 41, 42, 43, 44, 45, and 46 are made to operate to develop the latent images on the peripheral surfaces of the photosensitive drums 1 (1*a*, 1*b*, 1*c*, 1*d*, 1*e*, and 1*f*) into visible images (images formed of toner composed essentially of resin and pigment).

Referring to FIG. 14, each developing apparatus is supplied with toner from one of toner storage portions 61-66 (hoppers) with a predetermined timing so that the toner ratio (or amount of toner) in the developing apparatus remains constant. The toner storage portions 61-66 are located immediately below the laser based exposure optical systems 3.

The toner images having been formed on the photosensitive drums 1 (1*a*, 1*b*, 1*c*, 1*d*, 1*e*, and 1*f*) are sequentially transferred in layers (primary transfer) onto an intermediary transfer belt 5 as an intermediary transferring member, by the transferring apparatuses 5 (5*a*, 5*b*, 5*c*, 5*d*, 5*e*, and 5*f*).

The intermediary transfer belt 5 is stretched around the driver roller 51, follower roller 52, roller 53, and roller 54, and is driven by the driver roller 51. On the opposite side of the intermediary transfer belt 5 from the driver roller 51, a transfer belt cleaning apparatus 50 is located, which can be placed in contact with, or separated from, the intermediary transfer belt 5.

After the necessary number of monochromatic toner images different in color are transferred in layers onto the intermediary transfer belt 5, the transfer belt cleaning apparatus 50 is pressed against the driver roller 51 to remove the toner remaining on the intermediary transfer belt 5 after the transfer of the toner images from the intermediary transfer belt 5 onto a recording medium.

Meanwhile, from one of the recording medium storage portions 71, 72, and 73, or a manual feeding portion 74, recording mediums are conveyed, one by one, by one of the recording medium feeding means 81, 82, 83, and 84, respectively, to a pair of registration rollers 85, by which the recording mediums are straightened if they are askew, and are released with a predetermined timing to be delivered to a secondary transfer station 56, in which the toner images on the intermediary transfer belt 5 are transferred onto one of the recording mediums.

After the toner images are transferred onto the recording medium in the secondary transfer station 56, the recording medium is conveyed to a fixing apparatus 9 of a thermal roller type by way of a recording medium conveying portion 86. In the fixing apparatus 9, the toner images are fixed, and then, the recording medium is discharged into a delivery tray or a post-processing apparatus.

After the secondary transfer of the toner images, the toner remaining on the intermediary transfer belt 5 is removed by the transfer belt cleaning apparatus 50, and then, the intermediary transfer belt 5 is used again for the primary transfer process carried out in each of the image formation stations.

The operation for forming an image on both surfaces of a recording medium is as follows. Immediately after the transfer medium is passed through the fixing apparatus 9, the conveyance path guide 91 is driven, guiding the transfer medium into the reversing path 76 through the recording medium conveyance path 75. Then, the pair of reversing rollers 87 are rotated in reverse, conveying backward the transfer medium, that is, conveying the transfer medium in the direction opposite to the direction in which the transfer medium is guided into the reversing path 76, in other words, the end of the transfer medium, which was trailing when the transfer medium was guided into the reversing path 76, becoming the leading end. As a result, the transfer medium is moved into the two-sided print mode path 77. Thereafter, the transfer medium is conveyed by the pair of two-sided print mode rollers 88 to the aforementioned pair of registration rollers 85 through the two-sided print mode path 77. Then, it is straightened by the registration rollers 85 if it is askew, and is released with the predetermined timing, so that an image is transferred through the above described image formation process, on the opposite surface of the transfer medium from the surface on which an image has been already formed.

As described above, the image forming apparatus in this embodiment forms an image by carrying out virtually the same image formation process as that carried out by the image forming apparatus in the first embodiment shown in FIG. 1.

It will be described next how the image forming apparatus in this embodiment is controlled when it is operated in the various modes regarding glossiness.

Figure 15:
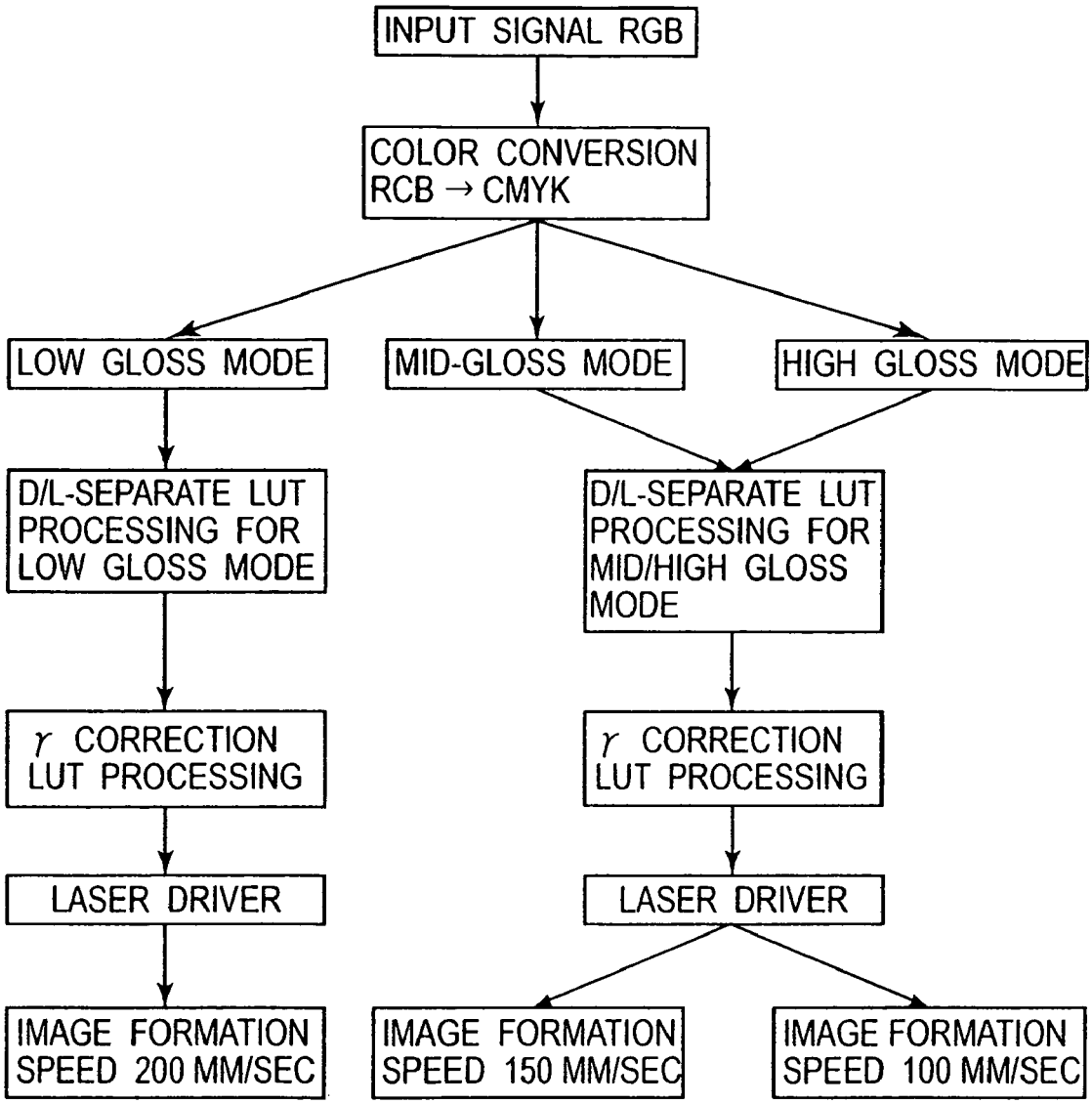
FIG. 15 is a flowchart for controlling the image forming apparatus in the third embodiment of the present invention.

As will be evident from FIG. 15 which is the flowchart for the image forming apparatus in this embodiment, the image forming apparatus in this embodiment is enabled to operate in three different modes regarding glossiness, that is, low gloss mode, intermediary gloss mode, and high gloss mode, which are different in glossiness level. The switching among the three modes is made by the laser output portion 100.

More specifically, the video signals representing R, G, B, and the like colors, are converted in color into C (cyan), M (magenta), Y (yellow), and K (black). Then, the resultant video signals representing C, M, Y, and K, are processed according to one of the three glossiness modes; the resultant video signals are sorted with reference to one of the LUTs, corresponding to the selected glossiness mode (high and low color density video signal apportionment process based on LUT). Then, the apportioned video signals are put through the gamma correction process, and used for driving the laser drivers to output an image.

To describe further, referring to FIG. 15, in this embodiment, one of the image formation modes is the low gloss mode which is expected to be used for forming an image on high quality paper or the like, and second image formation mode is the intermediary gloss mode which is expected to be used for forming an image on a recording medium, the glossiness level of which is no more than 40. The third image formation mode is the high gloss mode which is expected to be used for forming an image on a recording medium, the glossiness level of which is no less than 40. As for the high and low color density video signal apportionment LUT used in this embodiment, when in the low gloss mode, the LUT in FIG. 8 is used, whereas when in intermediary and high gloss modes, the LUT in FIG. 3 is used.

Next, it will be described how the operational speed of the image forming apparatus is controlled in each of the aforementioned three modes.

Referring to FIG. 15, when in the standard low gloss mode, the image forming apparatus is operated at 200 mm/sec. However, the glossiness level achievable by operating the apparatus at this speed is roughly no more than 20, being rather low. Thus, in this embodiment, the operational speed of the image forming apparatus, or at least, the fixation speed, is varied according to the selected gloss level mode. That is, when in intermediary gloss mode, the fixating apparatus is operated at 150 mm/sec, and when in high gloss mode, the fixing apparatus is operated at 100 mm/sec.

Figure 16:
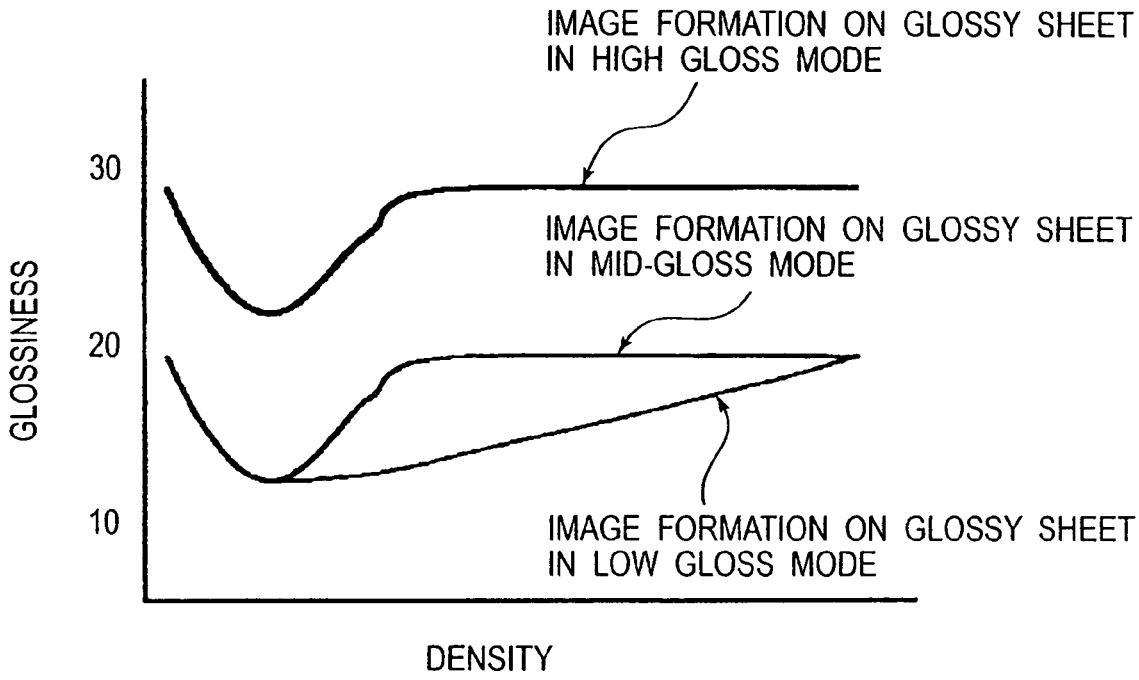
FIG. 16 is a graph showing the relationship between the color density level and the glossiness level achieved when an image is formed on a high gloss paper by operating the image forming apparatus in the third embodiment in the high, standard, and low gloss modes.
Figure 17:
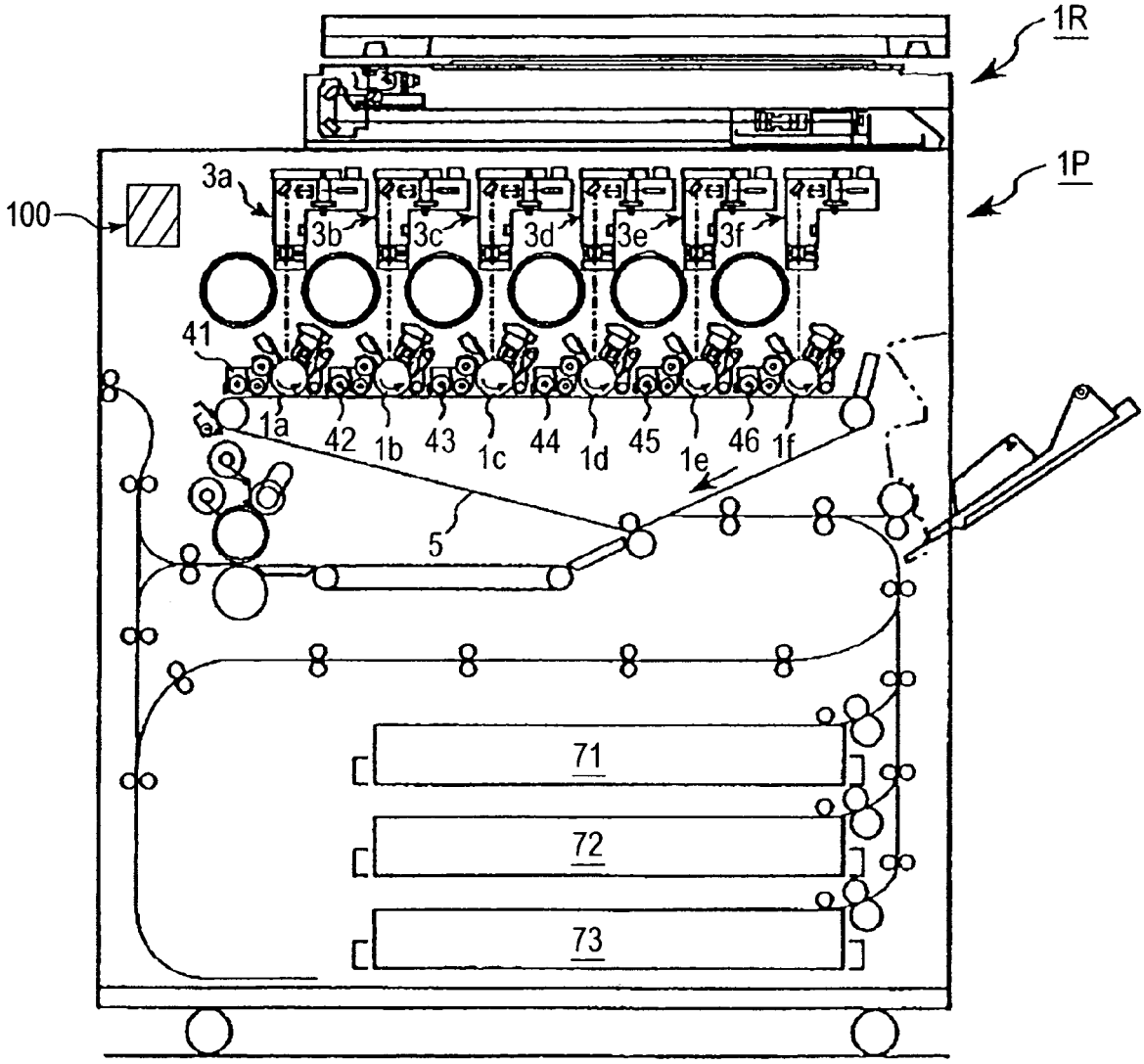
FIG. 17 is a schematic sectional view of an image forming apparatus of a tandem type which uses six toners different in hue or color density, showing the general structure thereof.

When the image forming apparatus is structured as described above, the glossiness characteristic in each mode becomes as shown in FIG. 16; it is optimized. This means that the glossiness level is substantially affected by the fixation speed.

Generally, the operational speed of an image forming apparatus, or the operational speed of at least the fixing apparatus thereof, is varied according to the thickness of a recording medium on which an image is formed. This control is also carried out in the case of this image forming apparatus. For example, when recording paper, the weight of which is no less than 150 g/m$^2$, is used, the optimal image formation speed in the standard low gloss mode is 100 mm/sec. Therefore, when in the intermediary and high gloss modes, the image formation speed is set to 70 mm/sec, and 50 mm/sec, respectively.

As described above, an optimal level of glossiness can be achieved by controlling the image formation speed (at least fixation speed) according to the apportioning of the video signals between the high and low color density developing apparatuses.

Figure 18:
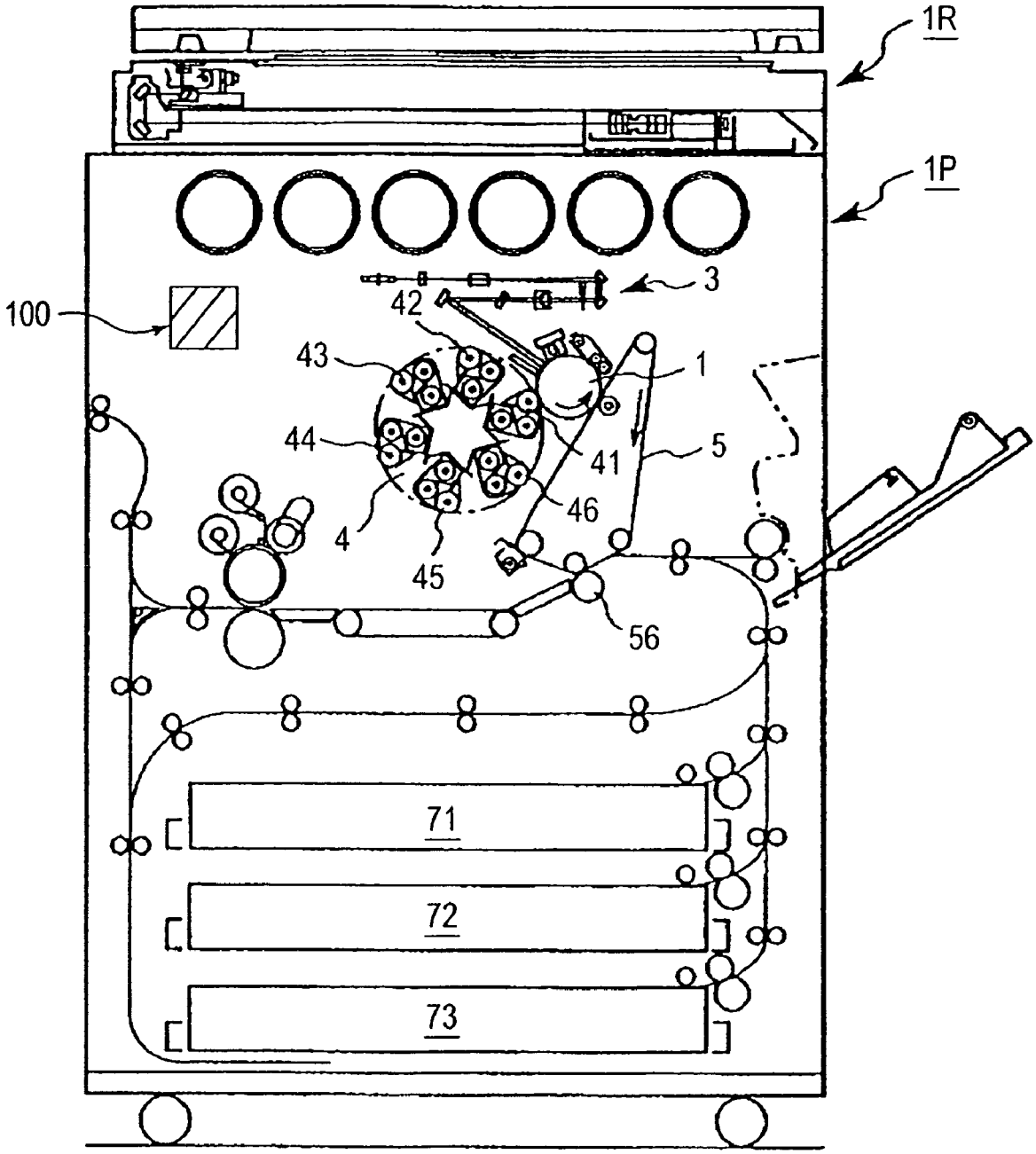
FIG. 18 is a schematic sectional view of an image forming apparatus which uses six toners different in hue or color density as does the image forming apparatus in FIG. 17, but, employs only a single photosensitive drum to accomplish the same effects as those accomplished by the image forming apparatus in FIG. 17, showing the general structure thereof.
Figure 19:
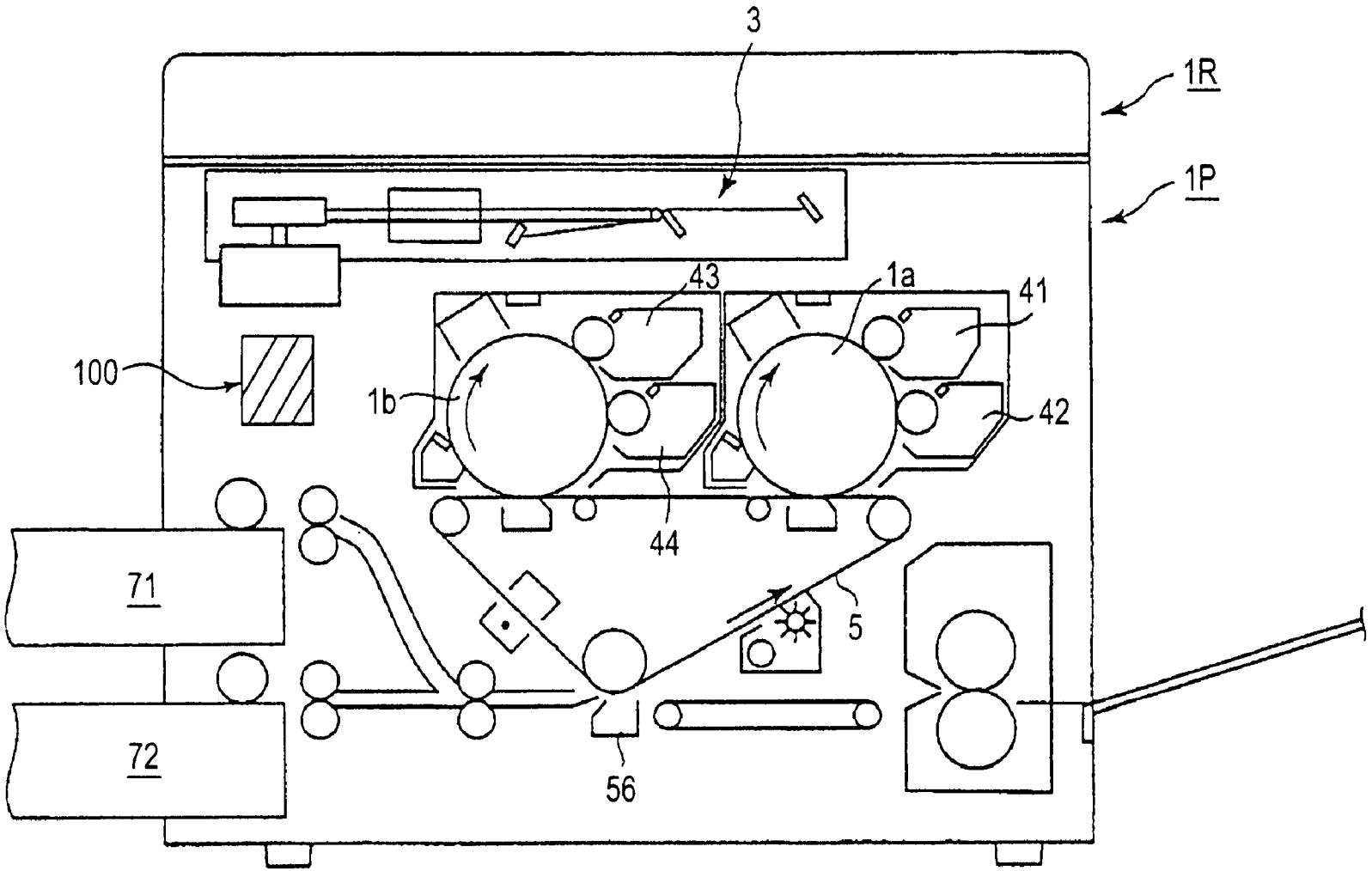
FIG. 19 is a schematic sectional view of an image forming apparatus which uses six toners different in hue or color density as does the image forming apparatus in FIG. 17, but, employs only two photosensitive drums to accomplish the same effects as those accomplished by the image forming apparatus in FIG. 17, showing the general structure thereof.

Although, in the above described embodiments 1, 2, and 3, of the present invention, the image forming apparatuses were structured as shown in FIG. 1 or 14, the present invention is also applicable to the image forming apparatuses structured as shown in FIGS. 18 and 19, and the effects attainable by such applications are the same as those attained in the image forming apparatuses in the embodiments 1, 2, and 3.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 204683/2003 filed Jul. 31, 2003, which is hereby incorporated by reference.

What is claimed is:

1. An image forming apparatus comprising:

a toner image forming device configured to form a toner image on a sheet to reproduce inputted image information using a light toner and a dark toner which has the same hue as the light toner and has a density higher than a density of the light toner; and a controlling device configured to control a ratio of an amount per unit area of the light toner to a total amount per unit area of the light toner and the dark toner in a predetermined density reproduction area based on the inputted image information in accordance with a glossiness of the sheet.

2. An image forming apparatus according to claim 1, wherein said controlling device controls said toner image forming device so that a ratio when the toner image is formed on a low glossiness sheet is lower than the ratio when the toner image is formed on a high glossiness sheet.

3. An image forming apparatus according to claim 2, wherein the predetermined density reproduction area is a high density reproduction area.

4. An image forming apparatus according to claim 3, wherein said controlling device controls said toner image forming device so that a ratio when the toner image is formed on a middle glossiness sheet mode is higher than a ratio when the toner image is formed on the low glossiness sheet and lower than the ratio when the toner image is formed on the high glossiness sheet.

* * * * *